United States Patent [19]

Kantor

[11] Patent Number: 4,703,565

[45] Date of Patent: Nov. 3, 1987

[54] FABRIC DRYER

[75] Inventor: Paul Kantor, Tulsa, Okla.

[73] Assignee: Micro Dry, Inc., Tulsa, Okla.

[21] Appl. No.: 871,690

[22] Filed: Jun. 9, 1986

[51] Int. Cl.[4] ..... F26B 11/04

[52] U.S. Cl. ..... 34/1; 34/133; 68/20

[58] Field of Search ..... 34/1, 4, 133, 202; 68/20, 26

[56] References Cited

U.S. PATENT DOCUMENTS

| | | | |
|---|---|---|---|
| 2,783,551 | 3/1957 | Giannini | 34/202 |
| 3,439,431 | 4/1969 | Heidtmann | 34/1 |
| 3,854,219 | 12/1974 | Staats | 34/1 |
| 4,359,640 | 11/1982 | Jansson | 34/1 |
| 4,490,923 | 1/1985 | Thomas | 34/1 |
| 4,510,361 | 4/1985 | Mahan | 34/1 |
| 4,617,743 | 10/1986 | Barnard | 34/128 |

*Primary Examiner*—Albert J. Makay
*Assistant Examiner*—David W. Westphal
*Attorney, Agent, or Firm*—Robert S. Salzman; Paul H. Johnson

[57] ABSTRACT

An improved fabric dryer having a cabinet with a closable door, a stationary microwave impermeable container within the cabinet having an opening contiguous to and in alignment with the cabinet opening and having air inlets and an air outlet opening, a magnetron for generating electromagnetic energy and a wave guide for directing the energy into the container, an air and microwave permeable basket removably positionable within the container through the opening therein, the basket having a latchable door and being adaptable to receive fabric therein to be dried, rollers within the container for rotating the basket to tumble fabric therein and a fan for drawing air out the container air outlet. The removable basket facilitates placing fabric into and out of the dryer.

17 Claims, 3 Drawing Figures

FABRIC DRYER

SUMMARY OF THE INVENTION

Apparatus for drying fabric is well known and it is frequently referred to as a clothes dryer. In addition to clothes such appliances are used to dry many other items including towels, sheets, pillow cases, diapers and so forth and such equipment has been accepted as a standard convenience in the United States and many other developed nations of the world substantially replacing the use of clothes lines for drying fabric.

Most fabric dryers in use today use heated air which is passed through the fabric as it is tumbled within the dryer. The air is typically heated either electrically or with a gas flame. While dryers of this type work successfully they are relatively energy inefficient.

The present invention is directed towards a fabric dryer in which water absorbed by fabric is heated directly by the use of electromagnetic energy to transform the water into water vapor. The water vapor is absorbed by air passing through the fabric as it is tumbled. By heating directly the water absorbed in the fabric rather than heating the air in which the fabric is tumbled, the application of energy to dry fabric is more directly and efficiently utilized.

Others have provided fabric dryers utilizing electromagnetic energy. Reference may be had to U.S. Pat. No. 4,490,923 issued to Perry W. Thomas on Jan. 1, 1985 as an example of a dryer utilizing microwave energy. The dryer disclosed in this patent to Thomas has many advantages over the prior art, including increased efficiency; however, it has one disadvantage and that is the fabric must be manually removed from an upright cabinet having an upright container within the cabinet. The user must reach into the opening in the top of the cabinet and the container and down to the bottom of the container to extract all fabric after it has been dried.

Another example of a fabric dryer utilizing electromagnetic energy is illustrated in U.S. Pat. No. 3,854,219 issued to James E. Staats on Dec. 17, 1974. While this patent contemplates a dryer having a front opening, the user is confronted with the same problem, that is the user must reach into the dryer and individually extract the items of fabric which have been dried. Another example of a clothes dryer utilizing electromagnetic energy is U.S. Pat. No. 3,439,431 issued to Heidtmann which has the same deficiencies as the first two recited dryers.

The present invention provides an improved fabric dryer and particularly provides one which is specifically adaptable to utilize the efficiency of electromagnetic energy but at the same time one in which the use of the dryer is greatly expedited in that the problem of reaching into the dryer to extract individual items is eliminated. The present invention employs a cabinet having an opening therein covered by a door. A stationary microwave impermeable container is positioned within the cabinet. The container has an access opening therein contiguous to and in alignment with the cabinet opening. Further, the container has an air inlet and an air outlet opening therein to permit the passage of air through the container. A magnetron is employed for generating electromagnetic energy. By the use of a wave guide the energy generated by the magnetron is conveyed into the container. An air and microwave permeable basket is removably positionable within the container through the opening and through the opening in the cabinet. The basket has a latchable door. The user of the dryer fills the basket, which may be made of relatively light weight plastic, while the basket is conveniently positioned on a table or other receptacle outside of the dryer. After the fabric to be dried is placed in the basket the door is closed and latched. The basket is then set into the dryer through the open door of the cabinet and the container.

Within the container means is provided for rotating the basket to thereby tumble the fabric in it. A fan is utilized to draw air through the container. The microwave energy within the container reacts directly with the water absorbed by the fabric, heating the water and thereby increasing the vapor pressure of the absorbed water. The air passing through the container readily absorbs water vapor. The air is thereby raised in humidity and temperature and is drawn out of the container and the cabinet.

When the fabric has been dried the tumbling action is stopped. The user then opens the door of the cabinet and reaches into the container to grasp the basket to remove it. The dried fabric can then be easily removed from the basket as it is positioned in a convenient area outside of the dryer. This alleviates the problem of the user having to reach into the dryer and attempt to locate each item of fabric which has been dried.

The invention will be better understood by reference to the following description and claims, taken in conjunction with detached drawings.

DESCRIPTION OF THE PREFERRED EMBODIMENTS

Figure 1:
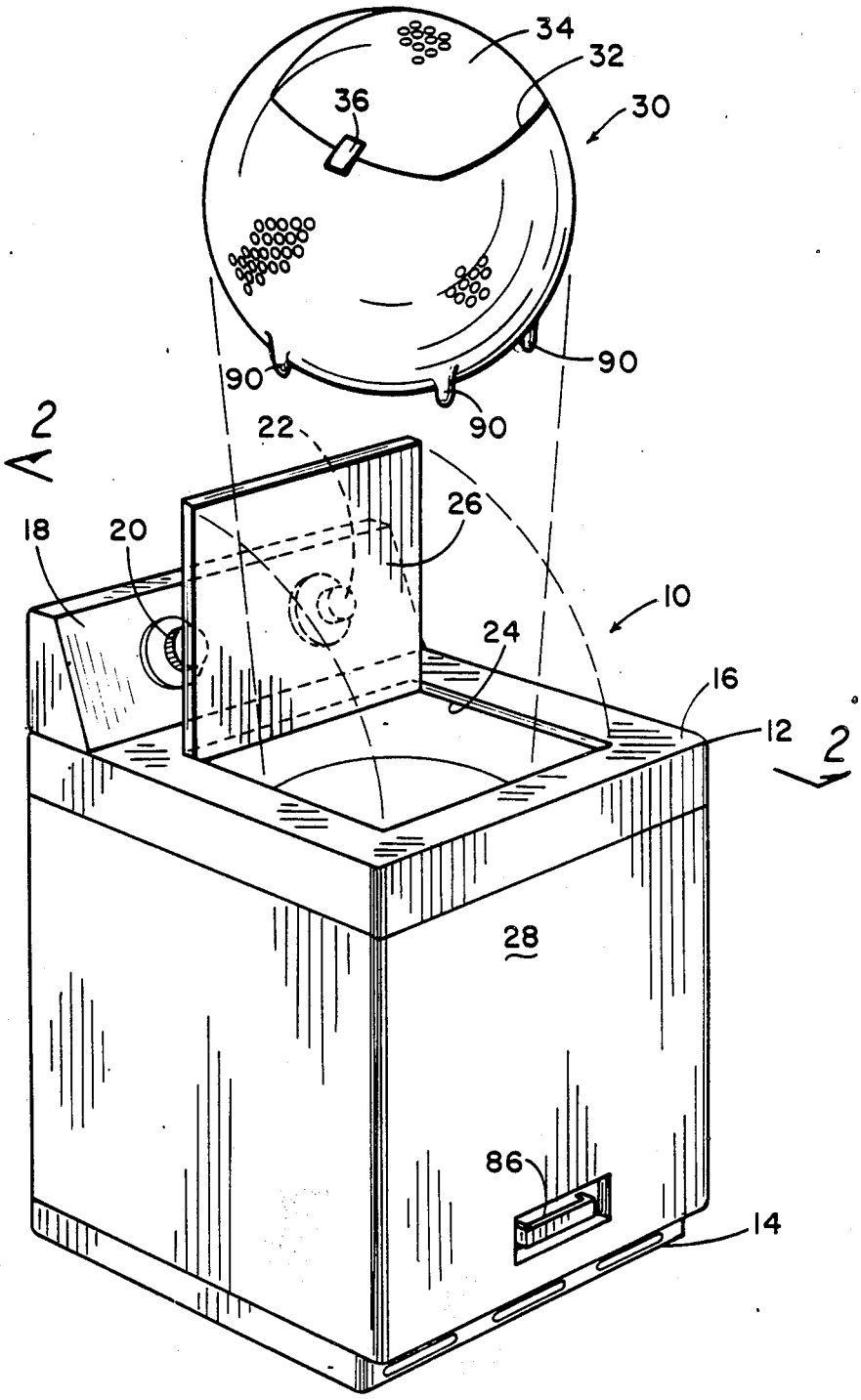
FIG. 1 is an isometric elevational view of a fabric dryer embodying the principles of this invention and showing, in exploded arrangement, one embodiment of a removable basket.

Referring first to FIG. 1, a fabric dryer which incorporates the principles of this invention is indicated generally by the numeral 10 and has an external appearance substantially the same as commercially available clothes dryers for domestic use. The dryer 10 includes a cabinet 12 having a bottom 14 on which it rests and a top 16. Extending upwardly from the top is an instrument panel 18 having controls thereon such as a timer control 20 and a temperature control 22.

Formed in the top 16 of the cabinet is an opening 24 which is closed by a hinged lid 26, the lid being shown in the open position.

The clothes dryer described up to this point is, as previously indicated, typically of commercially available clothes dryers for domestic use and for use such as in help-your-self laundries. The dryer 10 is shown with the opening 24 in the top; however, if preferred, the opening may be in the front 28 of the cabinet since the principles of this invention are applicable to either a top or front opening device.

Shown telescopically above the cabinet 12 is a basket generally indicated by the numeral 30. The illustrated basket is spherical, a preferred embodiment, but the shape of the basket is not so limited. The basket 30 has a fabric opening 32 which is closed by a hinged lid 34, the lid being retained in the closed position by a latch 36.

A unique feature of this invention is the provision of the removable basket 30. In the typical fabric dryer of the type presently commercially available, fabric to be dried including clothes, towels, sheets, pillow cases, blankets and so forth, are, after being washed and in a wet or damp state, are placed into the dryer, such as into opening 24 in the top, or an opening in the front. Within the dryer the clothes are dried, usually by tumbling action and heated air. After drying, the user opens the door of the cabinet and must extend his or her arm into the interior of the dryer to extract each item of fabric individually. Small items such as socks, handkerchiefs and so forth are easily left unfound within the dryer. By the present invention this exercise is eliminated. Instead, the user positions the basket 30 at some convenient location and height and deposits the wet fabric directly into the basket. Thereafter the lid 34 is closed and latched. The basket itself is then placed into the dryer. The lid 26 is closed and the dryer actuated. After the fabric is dried the user opens lid 26, reaches into the cabinet only far enough to manually engage the upper portion of the basket 30 and removes the entire basket. The basket can then again be placed at some convenient location and height and the fabric extracted. There is no requirement for seeking small fabric items which may be inadvertently left in the dryer as with presently available clothes dryers.

Figure 2:
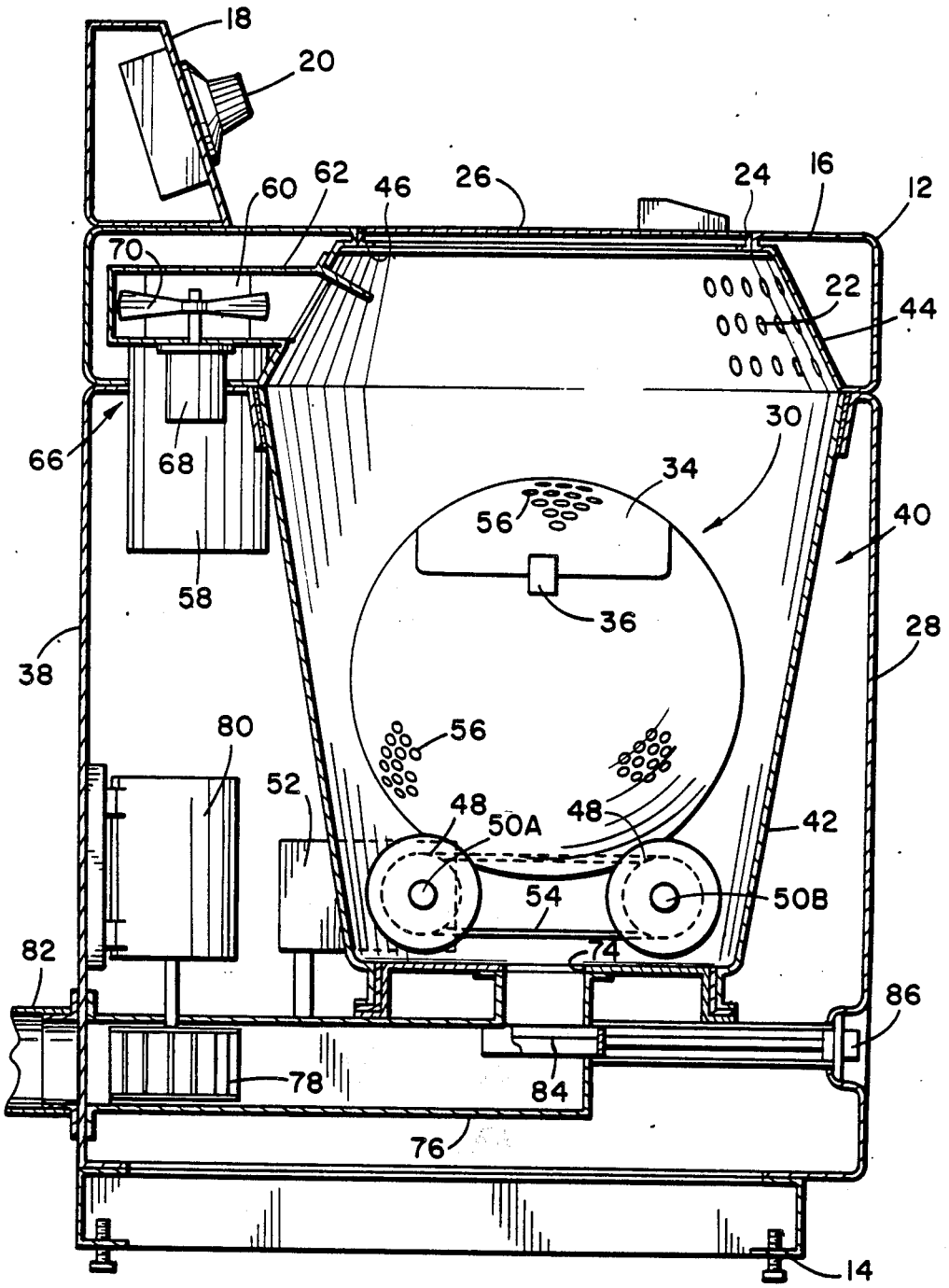
FIG. 2 is a cross-sectional view taken along the line 2—2 of FIG. 1 of one embodiment of the invention in which the container within the cabinet is stationary and of frustroconical configuration.

Referring to FIG. 2, a cross-sectional view of one embodiment of the invention is shown. In addition to the top 16, bottom 14 and front 28 the cabinet 12 has a back 38. Within the interior of the cabinet 12 is a container 40 which, in the embodiment illustrated, is frustoconical in configuration, that is, more specifically, has a frustroconical lower portion 42 and an inverted frustroconical upper portion 44. The container 40 has an opening 46 in the top thereof which is juxtaposed to and in alignment with the opening 24 in cabinet 12. When lid 26 is opened, access is provided to the interior of the container 40 through opening 46.

Positioned within the bottom of the container are four rollers 48, only two of which are shown. The rollers are supported about axles 50A and 50B, there being a roller on the opposite end of each axle. Axle 50A is turned by a motor 52 and by means of a belt 54. Axle 50B is also turned so that the four rollers 48 roll in unison. The basket 30 rests on the four rollers 48 so that with motor 52 energized the basket tumbles the fabric items positioned within it.

Basket 30 has a plurality of small openings 56 which freely permit air to pass therethrough. The openings 56 cover substantially the entire surface area of the basket. The basket is preferably formed of light-weight, electromagnetically permeable plastic material, by the use of plastic for forming the basket and the uniformily dispersed closely spaced openings 56, the basket is both air and microwave permeable.

It can be seen that with motor 52 energized, the basket 40 will freely rotate and tumble fabric articles within container 40. By the application of heat and the circulation of air the fabric within the basket can be expeditiously dried. After the fabric is dried, and motor 52 de-energized, basket 30 can easily be removed by the user lifting lids 26 and reaching to grasp the top of the basket. Openings 56 are preferably sufficiently large as to readily receive the fingers of the user so that the user can grasp the basket regardless of where it stops in its rotation and can expeditiously remove it.

While the invention is illustrated with a spherical basket, it can be seen that the basket could be cylindrical and when positioned on rollers 48, would rotate and thereby tumble items of fabric within it.

The other features of the embodiment of FIG. 2 are substantially the same as those shown in U.S. Pat. No. 4,490,923, previously referenced. To apply energy to dry fabric within the rotating basket 30, a magnetron 58 is used. The magnetron generates electromagnetic energy disseminated by antennae 60 which is positioned in a wave guide 62. The wave guide communicates with the interior of container 40 through an opening 64. To scatter the waves of electromagnetic energy so that they will be more evenly distributed throughout the interior of container 40, a stirrer generally indicated by numeral 66, is employed. The stirrer includes a motor 68 which rotates metallic blades 70. Electromagnetic energy is reflected off the blades 70 so that the energy is scattered as it passes through opening 64 into the interior of container 40.

Small diameter openings 72 are formed in container 40 and specifically, in the upper portion 44. An air outlet opening 74 is provided in the bottom of the container and communicates with an air flow duct 76. A fan 78, driven by a motor 80, pulls air out of the interior of the container 40 through the outlet opening 46, and thereby pulls air into the container through the inlet opening 72. The air outlet ducts 76 connects with an exhaust hose 82 by which heated and vapor-laden air is discharged. A filter 84 is placed across the outlet opening 74 and is removable from the front of the cabinet 12 by means of a handle 86, the filter serving to collect lint.

While not shown, supplementary air heating means may be provided to heat air within the container 40 to augment the drying action achieved by the use of electromagnetic energy.

Figure 3:
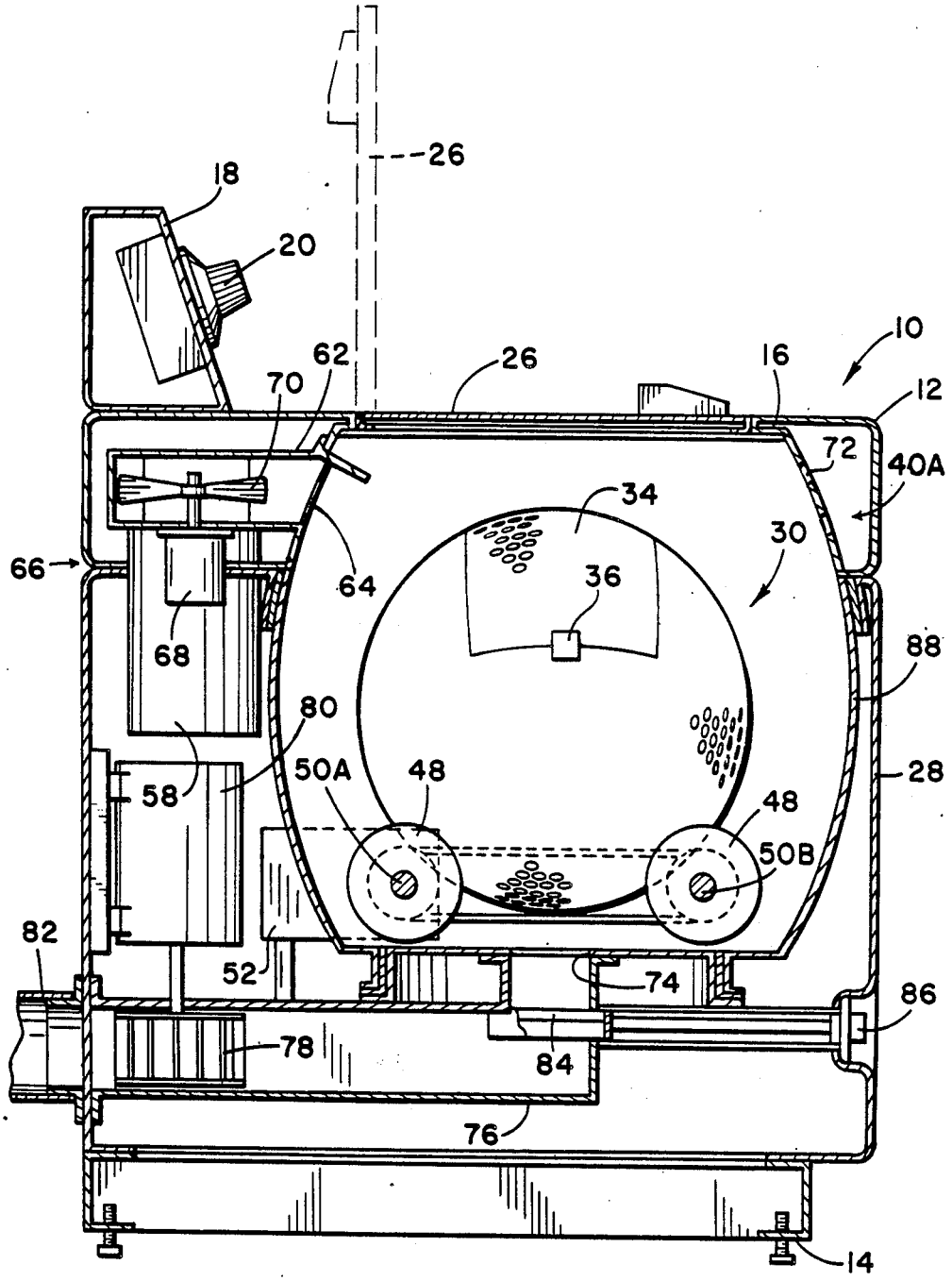
FIG. 3 is an elevational cross-sectional view as in FIG. 2 but showing an alternate configuration for the container.

FIG. 3 shows an alternate embodiment of the invention in which the container indicated by the numeral 40A is of a different configuration. In this embodiment the container is generally spherical and is truncated by horizontal planes at the top and bottom, the container wall being indicated by the numeral 88. This arrangement allows the height of the container to be substantially shortened and to thereby permit the cabinet 12 itself to be shortened. This reduces the height to which the basket 34 must be lifted to place it into and out of the dryer.

The invention thus described provides an improved fabric dryer. The convenience of removable basket 30 will be readily appreciated. As shown in FIG. 1 the basket may include short feet 90 on which the basket rests when being filled with damp fabric or when fabric after having been dried is being removed. It is apparent that the use of the feet 90 is optional since otherwise the spherical basket could easily be positioned in a short cylindrical seat (not shown) of an internal diameter less than the external diameter of the spherical basket when the basket is being filled or emptied.

As previously stated, the entry to the dryer shown in the drawing is in the top. While the invention is not so limited, nevertheless, the ability to provide a top entry dryer is a unique advantage of the design.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved fabric dryer comprising:

a cabinet having an opening therein covered by a door;

a stationary microwave impermeable container within said cabinet having an access opening therein contiguous to and in alignment with said cabinet opening and having an air inlet and an air outlet opening therein;

means for generating electromagnetic energy and for directing the electromagnetic energy into said container;

an air and microwave permeable, substantially spherical basket removably positionable within said container through said opening therein and through said cabinet opening, the basket having a latchable door and being adaptable to receive fabric therein to be dried;

means within said container for rotating said basket; and means for drawing air out of said container air outlet opening.

2. An improved fabric dryer according to claim 1 wherein said means of rotating said basket includes rollers on which said basket rests within said container.

3. An improved fabric dryer according to claim 1 wherein said opening in said container and in said cabinet are in the top of said container and cabinet.

4. An improved fabric dryer according to claim 1 including means to stir the electromagnetic energy entering into said container.

5. An improved fabric dryer comprising:

a cabinet having an opening therein covered by a door;

an air permeable, substantially cylindrical basket having an opening therein, the basket being adaptable to receive fabric therein to be dried, the basket being easily insertable into and removable from the interior of said cabinet through said cabinet opening;

a latchable door closing said opening in said basket;

means within said cabinet for supporting and rotating said basket whereby fabric therein is tumbled;

electromagnetic energy means for heating water absorbed by fabric within said basket, as the basket is rotated; and means for moving air through said basket to remove water from fabric therein.

6. An improved fabric dryer according to claim 5 including a microwave impermeable container within said cabinet, the cabinet having an access opening therein contiguous to and in alignment with said cabinet opening through which said basket may be inserted and removed, the container having at least one air inlet and at least one air outlet opening therein.

7. A fabric dryer, comprising:

a cabinet defining a fabric dryer housing having an opening for insertion and removal of a portable, rotatable dryer drum containing fabric;

a portable, rotatable dryer drum insertable within said cabinet in direct rotatable engagement with a drum spinning drive means but not fixtured thereto;

a drum spinning drive means disposed within said cabinet for spinning said inserted portable, rotatable dryer drum, whereby fabric is tumbled within said dryer drum;

heating means disposed within said cabinet for drying the fabric disposed within said portable, rotatable dryer drum; and means supported by said cabinet for extracting moisture from said fabric during the drying of said fabric.

8. The fabric dryer of claim 7, wherein said heating means comprises a microwave generator.

9. The fabric dryer of claim 8, wherein said portable receptacle includes a substantially spherical drum-basket, and further wherein, said spinning means comprises at least one rotatable support for freely-spinning said receptacle.

10. The fabric dryer of claim 9, wherein said drum-basket is microwave permeable, and contains apertures for the extraction of moisture from said fabric.

11. The fabric dryer of claim 7, wherein said portable receptacle includes a substantially spherical drum-basket, and further wherein, said spinning means comprises at least one rotatable support for freely-spinning said receptacle.

12. A method of loading, drying and spinning fabric, comprising the steps of:

(a) loading moisture-laidened fabric into a portable, rotatable dryer drum through a closable opening therein;

(b) placing said portable, rotatable dryer drum into a drying device in direct rotatable engagement with a drum spinning drive means but not fixtured thereto (c) spinning said portable, rotatable dryer drum within said dryer device, whereby said fabric is tumbled in said dryer drum while said fabric is being heated by said drying device for the purpose of driving moisture from said fabric (d) removing said portable, rotatable dryer drum from said drying device after said fabric is substantially dry; and (e) unloading said substantially dry fabric from said portable, rotatable dryer drum.

13. The method of claim 12, wherein said portable recptacle is freely-spinning within said drying device in accordance with step (c).

14. The method of claim 12, wherein said fabric is heated by microwave energy in step (c).

15. The method of claim 12, further comprising the step of: (f) extracting moisture from said drying device.

16. The method of claim 15, wherein said extracting step (f) is accomplished by circulating and venting air through and from said drying device.

17. A dual purpose portable, rotatable dryer drum for a fabric drying device which is used both as a carrier basket for fabric and as a spinning drum component, said portable, rotatable dryer drum comprising:

A substantially hollow, portable container having means defining an opening for the introduction to, and removal from, said container of fabric articles, said container being directly engagable with a drum spinning drive means but not fixtured thereto, when placed within said fabric drying device;

means defining a covering for said opening, said covering carried by said container; and venting means disposed upon said container defined as at least one aperture for the purpose of removing moisture from said fabric disposed in said container during a heating cycle of said fabric drying device.

* * * * *